US009890336B2

(12) United States Patent
Monson et al.

(10) Patent No.: US 9,890,336 B2
(45) Date of Patent: Feb. 13, 2018

(54) METHOD AND APPARATUS FOR THE PURIFICATION OF A HYDROCARBON-CONTAINING STREAM

(71) Applicant: ExxonMobil Chemical Patents Inc., Baytown, TX (US)

(72) Inventors: John J. Monson, League City, TX (US); Thomas J. Waddick, League City, TX (US); John R. Porter, Friendswood, TX (US); Albert F. Seibert, Austin, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 248 days.

(21) Appl. No.: 14/814,175

(22) Filed: Jul. 30, 2015

(65) Prior Publication Data

US 2016/0075954 A1 Mar. 17, 2016

Related U.S. Application Data

(60) Provisional application No. 62/051,346, filed on Sep. 17, 2014.

(51) Int. Cl.

| | |
|---|---|
| ***C10G 53/06*** | (2006.01) |
| ***C10G 21/16*** | (2006.01) |
| ***C10G 21/27*** | (2006.01) |

(52) U.S. Cl.

CPC ..... *C10G 53/06* (2013.01); *C10G 21/16* (2013.01); *C10G 21/27* (2013.01); *C10G 2300/202* (2013.01)

(58) Field of Classification Search

CPC ..... C10G 53/06; C10G 21/27; C10G 21/16; C10G 2300/202

See application file for complete search history.

(56) References Cited

U.S. PATENT DOCUMENTS

| | | | | |
|---|---|---|---|---|
| 2,273,660 A * | 2/1942 | Poole | C10G 21/02 196/14.52 |
| 3,274,096 A | 9/1966 | Bushnell et al. | |
| 3,537,984 A * | 11/1970 | Thompson | B01D 11/0488 208/321 |

(Continued)

FOREIGN PATENT DOCUMENTS

| | | |
|---|---|---|
| WO | WO 00/71494 | 11/2000 |

*Primary Examiner* — Randy Boyer
*Assistant Examiner* — Juan Valencia

(57) ABSTRACT

A method for removing sulfolane from hydrocarbon streams by serial separation using raffinate wash column and at least one raffinate wash drum. The separation may be particularly useful in retrofitting existing separation facilities to produce motor fuels meeting the specifications requiring lower sulfolane content. A method is provided for the purification of a hydrocarbon-containing stream having a sulfolane therein. The method includes separating a first sulfolane-depleted stream from a hydrocarbon stream in a first counter-current separation unit and then separating a second sulfolane-depleted stream from the first sulfolane-depleted stream in a second counter-current separation unit. The first and second counter-current separation units are preferably different and chosen from a raffinate wash column or at least one raffinate wash drum. An apparatus for performing the methods is also described.

20 Claims, 1 Drawing Sheet

(56) References Cited

U.S. PATENT DOCUMENTS

| | | | | |
|---|---|---|---|---|
| 5,582,714 | A * | 12/1996 | Forte | C10G 21/16<br>208/227 |
| 6,551,502 | B1 | 4/2003 | Lee et al. | |
| 8,663,461 | B2 | 3/2014 | Lee et al. | |
| 2014/0034446 | A1 | 2/2014 | Cretoiu et al. | |

* cited by examiner

METHOD AND APPARATUS FOR THE PURIFICATION OF A HYDROCARBON-CONTAINING STREAM

PRIORITY CLAIM

This application claims priority to and the benefit of U.S. Provisional Application No. 62/051,346, filed on Sep. 17, 2014, the disclosure of which is incorporated herein by reference in its entirety.

FIELD OF THE INVENTION

The invention is directed to purification of an aromatic hydrocarbon stream having sulfolane therein.

BACKGROUND OF THE INVENTION

Sulfolane is widely used as an industrial solvent, especially in the extraction of aromatic hydrocarbons from hydrocarbon mixtures and to purify natural gas. This process is sometimes referred to as "extractive desulfurization," particularly where sulfolane is used to reduce the concentration of sulfur-containing compounds. For example, in one such extractive desulfurization process, sulfolane is used to purify natural gas by removing $H_2S$, $CO_2$, COS and mercaptans from natural gas. Sulfolane is also effective in separating high purity aromatic compounds from hydrocarbon mixtures using liquid-liquid extraction. This process is widely used in refineries and the petrochemical industry. Because sulfolane is one of the most efficient industrial solvents for purifying aromatics, the process operates at a relatively low solvent-to-feed ratio, making sulfolane relatively cost effective compared to similar-purpose solvents. In addition, it is selective in a range that compliments distillation. Thus, distillation may be used to compliment sulfolane extraction. The resulting hydrocarbons are low in sulfur compounds. But because sulfolane itself contains sulfur, its content in the purified hydrocarbon needs to be reduced, e.g., to meet ever more stringent fuel standards.

Sulfolane removal systems are well known. Nevertheless removal of residual sulfolane from hydrocarbon streams remains challenging, particularly to levels recited in motor gasoline standards. Thus, a method of removing sulfolane from hydrocarbon streams, such as motor fuels, that also balances capital cost and operational efficiencies, particularly where such a method can be relatively easily incorporated into exiting sulfolane removal processes, would be useful.

SUMMARY OF THE INVENTION

It has been found that sulfolane may be economically removed from hydrocarbon streams by serial separation using a raffinate wash column and at least one raffinate wash drum. The separation may be particularly useful in retrofitting existing separation facilities to produce motor fuels meeting the specifications requiring lower sulfolane content. The methods are particularly useful where the hydrocarbon stream is first passed through a raffinate wash column followed by at least one, preferably at least 3, serially arranged wash drums.

In one embodiment, a hydrocarbon-containing stream comprising sulfolane is purified by separating a first sulfolane-depleted stream from a hydrocarbon stream in a first counter-current separation unit. The first sulfolane-depleted stream is sent to a second counter-current separation unit, where a second sulfolane-depleted stream is separated from the first sulfolane-depleted stream. The concentration of sulfolane in the second sulfolane-depleted stream is less than the concentration of sulfolane in the first sulfolane-depleted stream. The first and second counter-current separation units, which are preferably different, are selected from a raffinate wash column and at least one raffinate wash drum. The separations may be accomplished by contacting the hydrocarbon stream and first sulfolane-depleted stream with a first and second polar liquid, respectively.

In another embodiment, the sulfur content of a hydrocarbon-containing stream is reduced by extracting sulfur from the hydrocarbon-containing stream with sulfolane to form a sulfolane-rich extract, and a hydrocarbon-containing raffinate, which also contains some sulfolane and has less sulfur-containing compounds than the sulfolane-rich extract. The raffinate is then combined with a first polar liquid to form a first mixture, from which a first sulfolane-depleted stream is separated in a raffinate wash column. The first sulfolane-depleted stream is combined with a second polar liquid to form a second mixture, from which a second sulfolane-depleted stream is separated in at least a first static mixing drum. The concentration of sulfolane in the second sulfolane-depleted stream is less than the concentration of sulfolane in the first sulfolane-depleted stream.

An apparatus for the above described process is also provided, comprising a first counter-current separation unit, a second counter-current separation unit, and a counter-current solvent circulation system in fluid communication with the first counter-current separation unit and the second counter-current separation unit. The first and second separation units, which are preferably different, are selected from a raffinate wash column and at least one raffinate wash drum. Most preferably, the first counter-current separation unit comprises a raffinate wash column and the second counter-current separation unit comprises at least one raffinate wash drum.

DETAILED DESCRIPTION

Figure 1:
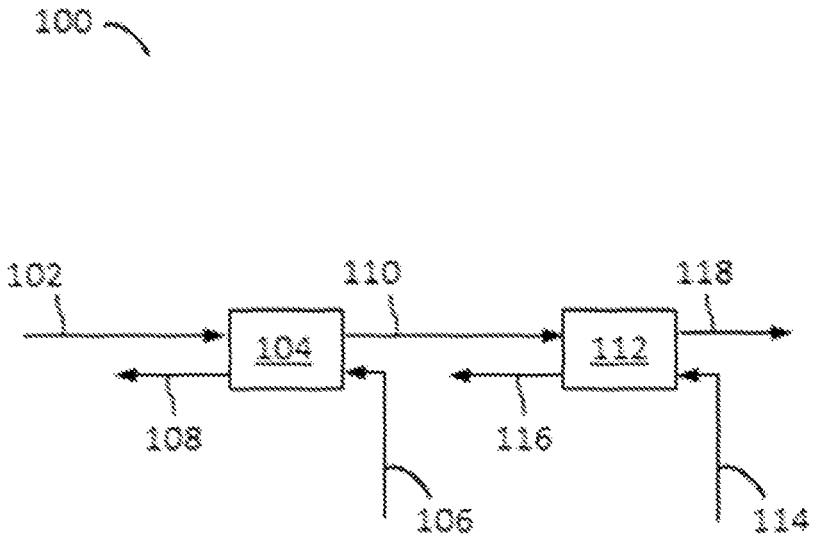
FIG. 1 schematically illustrates a hydrocarbon purification process according to aspects of the invention.

The invention relates to methods of separating sulfolane from hydrocarbon streams through serial separation using a raffinate wash column and at least one raffinate wash drum. As used herein the term "sulfolane" is used to describe chemical compounds meeting the following formula:

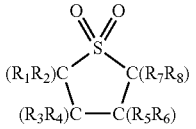

wherein R1-R8 may be the same or different and are selected from H, linear or branched, substituted or unsubstituted C1-C10 hydrocarbyl groups, e.g., methy, ethyl, n-propyl, i-propyl, n-butyl, i-butyl, t-butyl, and analogues containing one or more halogen in place of hydrogen atoms, e.g., dichloro-t-butyl. Typically, however, $R_1$ to $R_8$ are each hydrogen, i.e., 2,3,4,5-tetrahydrothiophene-1,1-dioxide.

Particular hydrocarbon streams include motor gasoline, jet fuel, heavy fuels including fuel oil, e.g., petroleum distillates as well as residue (i.e., resid), vacuum gas oil, atmospheric gas oil, heavy fuel oil, furnace fuel oil, Number 1 fuel oil (i.e., coal oil, stove oil and range oil), Number 2 and 3 fuel oil (e.g., Bunker A fuel, home heating oil, diesel fuel, and light gas oil); Number 4 fuel oil (e.g. heating oil from heavy gas oil); Number 5 fuel oil (e.g., Bunker B fuel, typically from heavy gas oil or a blend of residual oil and Number 2 fuel oil); Number 6 fuel oil is a high-viscosity residual oil requiring preheating to 104-127° C. (e.g., Bunker C fuel). Number 5 and 6 fuels are sometimes referred to as navy special fuel oil or navy special. The term residue (or resid) means the material remaining after the more cuts of crude oil have been removed by distillation. Another fuel is referred to as Mazut is derived from Russian petroleum sources.

Particular hydrocarbon streams have a Research Octane Number (RON)≥ about 50.0, e.g., ≥ about 55.0, ≥ about 60.0, ≥ about 65.0, ≥ about 70.0, ≥ about 75.0, ≥ about 80.0, ≥ about 85.0, ≥ about 90.0, ≥ about 95.0, ≥ about 100.0, or ≥ about 110.0. Additionally or alternatively, the hydrocarbon stream may have an RON of ≤ about 110.0, ≤ about 100.0, ≤ about 95.0, ≤ about 90.0, ≤ about 85.0, ≤ about 80.0, ≤ about 75.0, ≤ about 70.0, ≤ about 65.0, ≤ about 60.0, or ≤ about 55.0. Ranges of RON values for the hydrocarbon stream expressly disclosed include combinations of any of the above-enumerated values, e.g., about 50.0 to about 110.0, about 50.0 to about 100.0, about 50.0 to about 95.0, about 50.0 to about 90.0, about 50.0 to about 85.0, about 50.0 to about 80.0, about 50.0 to about 75.0, about 50.0 to about 70.0, about 50.0 to about 65.0, about 50.0 to about 60.0, or about 50.0 to about 55.0, etc.

The hydrocarbon stream may be characterized by a Motor Octane Number (MON)≥ about 50.0, e.g., ≥ about 55.0, ≥ about 60.0, ≥ about 65.0, ≥ about 70.0, ≥ about 75.0, ≥ about 80.0, ≥ about 85.0, ≥ about 90.0, ≥ about 95.0, ≥ about 100.0, or ≥ about 110.0. Additionally or alternatively, the hydrocarbon stream may have an MON of ≤ about 110.0, ≤ about 100.0, ≤ about 95.0, ≤ about 90.0, ≤ about 85.0, ≤ about 80.0, ≤ about 75.0, ≤ about 70.0, ≤ about 65.0, ≤ about 60.0, or ≤ about 55.0. Ranges of MON values for the hydrocarbon stream expressly disclosed include combinations of any of the above-enumerated values, e.g., about 50.0 to about 110.0, about 50.0 to about 100.0, about 50.0 to about 95.0, about 50.0 to about 90.0, about 50.0 to about 85.0, about 50.0 to about 80.0, about 50.0 to about 75.0, about 50.0 to about 70.0, about 50.0 to about 65.0, about 50.0 to about 60.0, or about 50.0 to about 55.0 etc.

The hydrocarbon stream may additionally or alternatively be characterized by a density, measured according to (according to ASTM D4052-11) at 20° C. of ≥ about 550 kg/m$^3$, e.g., ≥ about 600 kg/m$^3$, ≥ about 650 kg/m$^3$, ≥ about 700 kg/m$^3$, ≥ about 750 kg/m$^3$, ≥ about 800 kg/m$^3$, ≥ about 850 kg/m$^3$, ≥ about 900 kg/m$^3$, ≥ about 950 kg/m$^3$, ≥ about 1000 kg/m$^3$. Additionally or alternatively the hydrocarbon stream may be characterized by a density≤ about 1050 kg/m$^3$, e.g., ≤ about 1000 kg/m$^3$, ≤ about 950 kg/m$^3$, ≤ about 900 kg/m$^3$, ≤ about 850 kg/m$^3$, ≤ about 800 kg/m$^3$, ≤ about 750 kg/m$^3$, ≤ about 700 kg/m$^3$, ≤ about 650 kg/m$^3$, or ≤ about 600 kg/m$^3$. Ranges of density values for the hydrocarbon stream expressly disclosed include combinations of any of the above-enumerated values, e.g., about 550 to about 1050 kg/m$^3$, about 550 to about 1000 kg/m$^3$, about 550 to about 950 kg/m$^3$, about 550 to about 900 kg/m$^3$, about 550 to about 850 kg/m$^3$, about 550 to about 800 kg/m$^3$, about 550 to about 750 kg/m$^3$, about 550 to about 700 kg/m$^3$, about 550 to about 650 kg/m$^3$, or about 550 to about 600 kg/m$^3$, etc.

The kinetic viscosity of the hydrocarbon stream is not critical. Typically the kinetic viscosity (measured by ASTM D 445) at 40° C. is ≥ about 0.500 cSt, e.g., ≥ about 0.50 cSt, ≥ about 0.65 cSt, ≥ about 0.75 cSt, ≥ about 1.0 cSt, ≥ about 2.0 cSt, ≥ about 5.0 cSt, ≥ about 25.0 cSt, ≥ about 75.0 cSt, ≥ about 100.0 cSt, ≥ about 250.0 cSt, ≥ about 500.0 cSt, about 750.0 cSt, or ≥ about 1000.0 cSt. Additionally or alternatively, the kinematic viscosity may be ≤ about 1000 cSt, e.g., ≤ about 1000.0 cSt, ≤ about 750.0 cSt, ≤ about 500.0 cSt, ≤ about 250.0 cSt, ≤ about 100.0 cSt, ≤ about 75.0 cSt, ≤ about 50.0 cSt, ≤ about 25.0 cSt, ≤ about 5.0 cSt, ≤ about 2.0 cSt, ≤ about 1.0 cSt, ≤ about 0.75 cSt, or ≤ about 0.65 cSt. Ranges of the kinematic viscosity expressly disclosed include all ranges bound by combinations of the above-enumerated values, e.g., about 0.50 to about 1000.0, 0.50 to about 750.0, about 0.50 to about 500.0, about 0.50 to about 250.0, 0.50 to about 100.0, about 0.50 to about 75.0, about 0.50 to about 50.0 about 0.50 to about 25.0, about 0.50 to about 5.0, about 0.50 to about 2.0, about 0.50 to about 1.0, about 0.50 to about 0.75, or about 0.50 to about 0.65, etc.

The hydrocarbon stream may additionally or alternatively be characterized by its boiling point profile. For example, some hydrocarbon streams may have an initial boiling point (IBP) of ≥ about 30° C., e.g., ≥ about 35° C., ≥ about 40° C., ≥ about 45° C., ≥ about 50° C., ≥ about 60° C., ≥ about 70° C., ≥ about 80° C., ≥ about 90° C., ≥ about 100° C., ≥ about 125° C., or ≥ about 150° C. Additionally or alternatively, the initial boiling point may be ≤ about 150° C., e.g., ≤ about 125° C., ≤ about 100° C., ≤ about 90° C., ≤ about 80° C., ≤ about 70° C., ≤ about 60° C., ≤ about 50° C., ≤ about 45° C., ≤ about 40° C., or ≤ about 35° C. Ranges of the initial boiling point expressly disclosed include ranges bound by all combinations of the above-enumerated values, e.g., about 30 to about 150° C., about 30 to about 125° C., about 30 to about 100° C., about 30 to about 90° C., about 30 to about 80° C., about 30 to about 70° C., about 30 to about 60° C., about 30 to about 50° C., about 30 to about 40° C., or about 30 to about 35° C., etc.

Particular hydrocarbon streams may have a boiling point profile such that, additionally or alternatively to the initial boiling point, a specified amount of the hydrocarbon has vaporized by a particular temperature. For example, some hydrocarbon streams suitable for use herein may have a profile such that 50 vol % of the hydrocarbon stream has vaporized (sometimes referred to as the 50% boiling point) at a temperature≥ about 70° C., e.g., ≥ about 80° C., ≥ about 90° C., ≥ about 100° C., ≥ about 150° C., ≥ about 200° C., or ≥ about 300° C. Additionally or alternatively, the 50% boiling point may be ≤ about 300° C., e.g., ≤ about 200° C., ≤ about 150° C., ≤ about 100° C., ≤ about 90° C., ≤ about 80° C., ≤ about 70° C. Ranges of the 50% boiling point expressly disclosed include ranges bound by all combinations of the above-enumerated values, e.g., about 70 to about 300° C., about 70 to about 200° C., about 70 to about 150° C., about 70 to about 100° C., about 70 to about 90° C., about 70 to about 80° C., etc. Additionally or alternatively the hydrocarbon stream may have a 95% boiling point of ≥ about 100° C., e.g., ≥ about 105° C., ≥ about 110° C., ≥ about 125° C., ≥ about 130° C., ≥ about 135° C., ≥ about 140° C., ≥ about 145° C., ≥ about 150° C., ≥ about 160° C., ≥ about 170° C., ≥ about 180° C. Additionally or alternatively, the 90% boiling point may be ≤ about 180° C., e.g., ≤ about 180° C., ≤ about 170° C., ≤ about 160° C., ≤ about 150° C., ≤ about 145° C., ≤ about 140° C., ≤ about 135° C., ≤ about 130° C., ≤ about 125° C., ≤ about 110° C., ≤ or about 105° C. Ranges of the 95% boiling point expressly disclosed include ranges bound by all combinations of the above-enumerated values, e.g., about 100 to about 180° C., about 100 to about 170° C., about 100 to about 160° C., about 100 to about 150° C., about 100 to about 145° C., about 100 to about 140° C., about 100 to about 135° C., about 100 to about 130° C., about 100 to about 125° C., about 100 to about 110° C., or about 100 to about 105° C., etc.

The hydrocarbon stream may include sulfolane in any amount; however, the amount is typically that remaining in a hydrocarbon stream after conventional sulfolane extraction. For example, sulfolane may be present in at a concentration of ≤ about 5.0 wt %, e.g., ≤ about 4.0 wt %, ≤ about 3.0 wt %, ≤ about 2.5 wt %, ≤ about 1.5 wt %, ≤ about 1.0 wt %, or ≤ about 0.50 wt %. Additionally or alternatively, the sulfolane remaining in the hydrocarbon stream after conventional sulfolane extraction may be ≥ about 0.05 wt %, e.g., ≥ about 0.10 wt %, ≥ about 0.25 wt %, ≥ about 0.50 wt %, ≥ about 1.0 wt %, ≥ about 2.5 wt %, ≥ about 3.0 wt %, or ≥ about 4.0 wt %. Ranges of the sulfolane content expressly disclosed include ranges bound by all combinations of the above-enumerated values, e.g., about 0.05 to about 5.0 wt %, about 0.05 to about 4.0 wt %, about 0.05 to about 3.0 wt %, about 0.05 to about 2.5 wt %, about 0.05 to about 1.5 wt %, about 0.05 to about 1.0 wt %, about 0.05 to about 0.5 wt %, about 0.05 to about 0.25 wt %, about 0.05 to about 0.10 wt %, etc., particularly about 0.5 to about 5.0 wt %, about 0.5 to about 4.0 wt %, about 0.5 to about 3.0 wt %, or about 0.5 to about 2.5 wt %.

The hydrocarbon stream having sulfolane therein is combined with a first polar fluid in a first counter-current separation unit for removal of at least a portion of the sulfolane. The first counter-current separation unit may comprise one or more of any type of counter-current separation unit, e.g., raffinate wash column, one or more raffinate wash drums, etc. In a preferred embodiment, the first counter-current separation unit comprises one or more raffinate wash columns, e.g., 1 to 10 serially connected wash columns, preferably 1 to 5 serially connected wash columns, more preferably 1 to 3 serially connected wash columns, and most preferably 1 raffinate wash column. Typically, the raffinate wash column provides 1 to 10 theoretical stages. An exemplary raffinate wash column is described in U.S. Pat. No. 4,342,646, incorporated herein by reference in its entirety. Alternatively, the first counter-current separation unit may comprise one or more raffinate wash drums, e.g., 1 to 10 serially connected wash drums, preferably 1 to 5 serially connected wash drums, more preferably 3 to 5 serially connected wash drums, and most preferably 3 serially connected wash drums.

The first polar fluid may be selected from water, a $C_1$-$C_4$ alcohol, and mixtures thereof. In any aspect, the first polar fluid used to remove at least a portion of the sulfolane in the first counter-current separation unit may be water, methanol, ethanol, or mixtures thereof, particularly water. As used in this context the phase "at least a portion of" means≥ about 10 wt %, e.g., ≥ about 20 wt %, ≥ about 30 wt %, ≥ about 40 wt %, ≥ about 50 wt %, ≥ about 60 wt %, ≥ about 70 wt %, ≥ about 80 wt %, ≥ about 85 wt %, ≥ about 90 wt %, ≥ about 95 wt %, or ≥ about 99 wt % of the sulfolane in the hydrocarbon stream, based on the initial weight of sulfolane in the hydrocarbon stream compared to the weight of sulfolane in a first sulfolane-depleted stream exiting the first counter-current separation unit. Additionally or alternatively, the phrase "at least a portion of" means≤ about 99 wt %, e.g., ≤ about 95 wt %, ≤ about 90 wt %, ≤ about 85 wt %, ≤ about 80 wt %, ≤ about 70 wt %, ≤ about 60 wt %, ≤ about 50 wt %, ≤ about 40 wt %, ≤ about 30 wt %, ≤ about 20 wt %, ≤ about 10 wt % of the sulfolane initially present in the hydrocarbon stream. Ranges of the amount of sulfolane that may be removed in the first counter-current separation unit expressly disclosed include ranges bound by all combinations of the above-enumerated values, e.g., about 10 to about 99 wt %, about 20 to about 99 wt %, about 30 to about 99 wt %, about 40 to about 99 wt %, about 50 to about 99 wt %, about 60 to about 99 wt %, about 70 to about 99 wt %, about 80 to about 99 wt %, about 90 to about 99 wt %, about 95 to about 99 wt %, etc.

The first sulfolane-depleted stream exits the first counter-current separation unit where it is combined with a second polar fluid in a second counter-current separation unit. The second counter-current separation unit may comprise one or more of any type of counter-current separation unit, e.g., raffinate wash column, one or more raffinate wash drums, etc. In a preferred embodiment, the second counter-current separation unit comprises one or more raffinate wash drums, e.g., 1 to 10 serially connected wash drums, preferably 1 to 5 serially connected wash drums, more preferably 3 to 5 serially connected wash drums, and most preferably 3 serially connected wash drums. Alternatively, the second counter-current separation unit comprises one or more raffinate wash columns, e.g., 1 to 10 serially connected wash columns, preferably 1 to 5 serially connected wash columns, more preferably 1 to 3 serially connected wash columns, and most preferably 1 raffinate wash column. As described for the first separation unit, the raffinate wash column typically provides 1 to 10 theoretical stages.

In a preferred embodiment, the first counter-current separation unit and second counter-current separation unit are different. Processes where the first counter-current separation unit comprises a raffinate wash tower and the second counter-current separation unit process comprises one or more raffinate wash drums are particularly useful.

The second polar fluid may be the same as or different than the first polar fluid and is selected from water, a $C_1$-$C_4$ alcohol, and mixtures thereof. In any aspect, the second polar fluid may be water, methanol, ethanol, or mixtures thereof, particularly water. The second counter-current separation unit removes at least a portion of sulfolane remaining in the first sulfolane-depleted stream. In this context the phrase "at least a portion of" means≥ about 10 wt %, e.g., ≥ about 20 wt %, ≥ about 30 wt %, ≥ about 40 wt %, ≥ about 50 wt %, ≥ about 60 wt %, ≥ about 70 wt %, ≥ about 80 wt %, ≥ about 85 wt %, ≥ about 90 wt %, ≥ about 95 wt %, or ≥ about 99 wt % of the sulfolane in the first sulfolane-depleted stream, based on the initial weight of sulfolane in the first sulfolane-depleted stream compared to the weight of sulfolane in a second sulfolane-depleted stream exiting the second counter-current separation unit. Additionally or alternatively, the phrase "at least a portion of" means≤ about 99 wt %, e.g., ≤ about 95 wt %, ≤ about 90 wt %, ≤ about 85 wt %, ≤ about 80 wt %, ≤ about 70 wt %, ≤ about 60 wt %, ≤ about 50 wt %, ≤ about 40 wt %, ≤ about 30 wt %, ≤ about 20 wt %, or ≤ about 10 wt % of the sulfolane initially present in first sulfolane-depleted stream. Ranges of the amount of sulfolane that may be removed in the second counter-current separation unit expressly disclosed include ranges bound by all combinations of the above-enumerated values, e.g., about 10 to about 99 wt %, about 20 to about 99 wt %, about 30 to about 99 wt %, about 40 to about 99 wt %, about 50 to about 99 wt %, about 60 to about 99 wt %, about 70 to about 99 wt %, about 80 to about 99 wt %, about 90 to about 99 wt %, about 95 to about 99 wt %, etc.

Typically, the concentration of sulfolane remaining in the hydrocarbon after the second separation unit may be ≤ about 50 ppm, e.g., ≤ about 50 ppm, ≤ about 40 ppm, ≤ about 30 ppm, ≤ about 20 ppm, ≤ about 10 ppm, ≤ about 5 ppm, ≤ about 2 ppm, or ≤ about 1 ppm. Additionally or alternatively, the concentration of sulfolane remaining after the second separation unit may be ≥0 ppm, e.g., ≥ about 0.5 ppm, ≥ about 1 ppm, ≥ about 2 ppm, ≥ about 5 ppm, ≥ about 10 ppm, ≥ about 20 ppm, ≥ about 30 ppm, or ≥ about 40 ppm. Ranges of the amount of sulfolane remaining after the second counter-current separation unit expressly disclosed include ranges bound by all combinations of the above-enumerated values, e.g., about 0 to about 50 ppm, about 0 to about 40 ppm, about 0 to about 30 ppm, about 0 to about 20 ppm, about 0 to about 10 ppm, about 0 to about 5 ppm, about 0 to about 2 ppm, about 0 to about 1 ppm, etc., particularly about 0 to about 5 ppm, or about 0 to about 2 ppm.

The amount of sulfolane in the second sulfolane-depleted stream exiting the second counter-current separation unit may also be expressed as a ratio (wt:wt) of the amount of sulfolane in the second sulfolane-depleted stream exiting the second counter-current separation unit to that in the hydrocarbon stream. The ratio may be ≤ about 0.80, e.g., ≤ about 0.5, ≤ about 0.20, ≤ about 0.10, ≤ about 0.05, ≤ about 0.01, ≤ about 0.005, ≤ about 0.001, ≤ about 0.0005, or ≤ about 0.0001. Additionally or alternatively, the ratio of the amount (wt) of sulfolane in the second sulfolane-depleted stream to that in the hydrocarbon stream may be ≥ about 0.0001, e.g., ≥ about 0.0005, ≥ about 0.001, ≥ about 0.005, ≥ about 0.01, ≥ about 0.05, ≥ about 0.10, ≥ about 0.20, ≥ about 0.5, or ≥ about 0.8. Ranges of the ratio of the amount of sulfolane in the second sulfolane-depleted stream to that in the hydrocarbon stream expressly disclosed include ranges bound by all combinations of the above-enumerated values, e.g., about 0.0001 to about 0.80, 0.001 to about 0.20, about 0.005 to about 0.10, or 0.01 to about 0.05, etc.

In another embodiment, the sulfur content of a hydrocarbon-containing stream is reduced by extracting sulfur from the hydrocarbon-containing stream with sulfolane to form a sulfolane-rich extract, and a hydrocarbon-containing raffinate, which also contains some sulfolane and has less sulfur-containing compounds than the sulfolane-rich extract. The raffinate is then combined with a first polar liquid to form a first mixture, from which a first sulfolane-depleted stream is separated in a raffinate wash column. The first sulfolane-depleted stream is combined with a second polar liquid to form a second mixture, from which a second sulfolane-depleted stream is separated in at least a first static mixing drum. The concentration of sulfolane in the second sulfolane-depleted stream is less than the concentration of sulfolane in the first sulfolane-depleted stream.

FIG. 1 schematically illustrates a process 100 according to aspects of the invention. In process 100, a hydrocarbon stream 102 having an initial amount of a sulfolane therein is provided to first counter-current separation unit 104. As hydrocarbon stream 102 flows through first counter-current separation unit 104, it is combined with a first polar fluid 106 flowing in a generally opposite direction with respect to the hydrocarbon stream. The first polar fluid exits the first counter-current separation unit 104 as sulfolane-enriched stream 108 while the hydrocarbon stream exits the first counter-current separation unit 104 as first sulfolane-depleted stream 110. First sulfolane-depleted stream 110 flows to the second counter-current separation unit 112. As first sulfolane-depleted stream 110 flows through second counter-current separation unit 112, it is combined with a second polar fluid 114 flowing in a generally opposite direction with respect to the hydrocarbon stream. The second polar fluid 114 exits the second counter-current separation unit 112 as second sulfolane-enriched stream 116 while the first sulfolane-depleted stream 110 exits the second counter-current separation unit as second sulfolane-depleted stream 118. Optionally, second sulfolane-enriched stream 116 may be combined with first polar fluid stream 106. In some embodiments, first polar fluid stream 106 may additionally or alternatively be provided to second separation unit 112, alone or in combination with second polar fluid 114.

Figure 2:
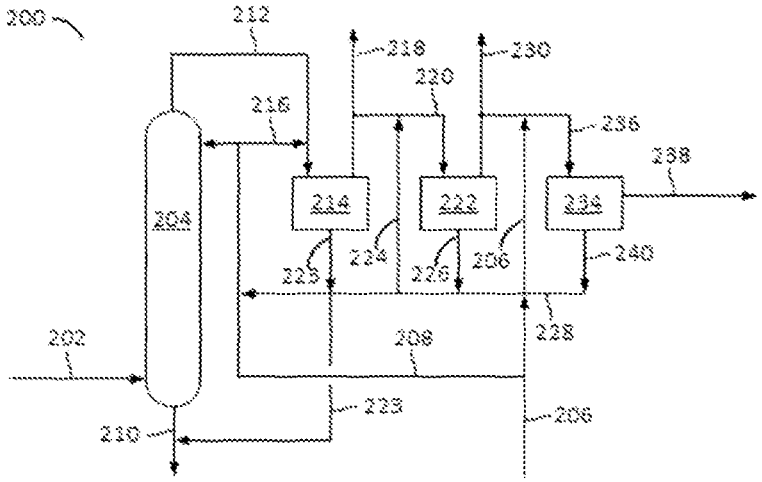
FIG. 2 schematically illustrates another hydrocarbon purification process according to particular aspects of the invention.

FIG. 2 schematically illustrates a process 200 according to another aspect of the invention. In process 200, hydrocarbon-containing stream 202 flows into a lower portion of raffinate wash column 204. As the hydrocarbon-containing stream 202 moves up the raffinate column 204, a polar liquid, e.g., water, is provided from water supply line 206 via line 208 to an upper portion of raffinate wash column 204. The polar liquid exits from the lower portion of raffinate wash column 204 as first sulfolane-enriched stream 210. First sulfolane-enriched stream 210 is typically conducted away from the process. A primarily hydrocarbon-containing stream exits the upper portion of the raffinate wash column as first sulfolane-depleted stream 212 and is transported to first raffinate wash drum 214, typically after being combined with at least a portion of the polar liquid via line 216.

First sulfolane-depleted stream 212 exits the raffinate wash drum 214 as second sulfolane-depleted stream via line 218. Second sulfolane-depleted stream may be removed from the process via line 218 and/or at least a portion thereof may be provided via line 220 to second raffinate wash drum 222. The polar liquid comprising extracted sulfolane exits raffinate wash drum as second sulfolane-enriched stream 223, which may be conducted away from the process e.g., via line 210, and/or recycled to the process, e.g., via line 228.

Although it is not required, the second sulfolane-depleted stream may be combined with a polar liquid, e.g., water, via line 206, 224 before entering the second wash drum 222. The polar liquid containing sulfolane extracted in the second raffinate wash drum 222 exits the second raffinate wash drum 222 as third sulfolane-enriched stream 226 which is typically, although not necessarily returned to line 228 for reuse. A primarily hydrocarbon-containing portion exits raffinate wash drum 222 as third sulfolane-depleted stream 230. Third sulfolane-depleted stream may be conducted away from the process and/or at least a portion thereof may be combined with polar liquid via line 206 before entering third wash drum 234 via line 236.

The combined stream in line 236 is separated in third raffinate wash drum 234 into a primarily hydrocarbon-containing stream that exits the wash drum as fourth sulfolane-depleted stream 238 and is conducted away from the process. A fourth sulfolane-enriched stream 240 comprising the polar liquid and extracted sulfolane exits raffinate wash drum 234 and is typically, although not necessarily recycled to the wash system, e.g., via line 228.

Additional Embodiments

Embodiment A

A method for the purification of a hydrocarbon-containing stream comprising sulfolane, the method comprising:

(a) separating a first sulfolane-depleted stream from a hydrocarbon stream in a first counter-current separation unit, (b) providing the first sulfolane-depleted stream to a second counter-current separation unit, and (c) separating a second sulfolane-depleted stream from the first sulfolane-depleted stream, wherein the first and second separation units are selected from the group consisting of a raffinate wash column and at least one raffinate wash drum, and wherein the first and second separation units are different.

Embodiment B

A method for the purification of a hydrocarbon-containing stream comprising sulfolane, the method comprising:

(a) combining a hydrocarbon-containing stream with a first polar liquid to form a first mixture in a raffinate wash column;

(b) separating a first sulfolane-depleted stream from said first mixture;

(c) combining said first sulfolane-depleted stream with a second polar liquid to form a second mixture; and (d) separating a second sulfolane-depleted stream from the second mixture in at least one raffinate wash drum; wherein the concentration of sulfolane in the second sulfolane-depleted stream is less than the concentration of sulfolane in the first sulfolane-depleted stream.

Embodiment C

A method of removing reducing sulfur content of a hydrocarbon-containing stream comprising:

(a) extracting a hydrocarbon-containing stream with sulfolane to form a sulfolane-rich extract and a hydrocarbon-containing raffinate, said raffinate containing an amount of sulfolane and having an amount of sulfur-containing compounds therein that is less than an amount of sulfur-containing compounds in the sulfolane-rich extract;

(b) combining the raffinate with a first polar liquid to form a first mixture, (c) separating a first sulfolane-depleted stream from said first mixture in a raffinate wash column;

(d) in at least a first static mixing drum, combining said first sulfolane-depleted stream with a second polar liquid to form a second mixture; and (e) separating from the second mixture a second sulfolane-depleted stream;

wherein the concentration of sulfolane in the second sulfolane-depleted stream is less than the concentration of sulfolane in the first sulfolane-depleted stream.

Embodiment D

The process of Embodiment A, wherein the first counter-current separation unit comprises at least one raffinate wash drum and the second separation unit comprises a raffinate wash column.

Embodiment E

The process of Embodiment A, wherein the first counter-current separation unit comprises a raffinate wash column and the second separation unit comprises at least one raffinate wash drum.

Embodiment F

The process of any one of Embodiments A-E, wherein the first and second polar liquid may be the same or different, and wherein the first and second polar liquids are selected from the group consisting of water, $C_1$-$C_4$ (particularly $C_1$-$C_2$) alcohols, and mixtures thereof.

Embodiment G

The process of any one of Embodiments B-F, wherein the raffinate wash column provides 1 to 10 theoretical stages.

Embodiment H

The process of any one of Embodiments A-G, further comprising recycling at least a portion of said sulfolane-depleted stream to the raffinate wash column.

Embodiment I

The process of any one of Embodiments A-H, further comprising combining said second sulfolane-depleted stream with a third polar liquid, which may be the same as or different than the first and second polar liquids, to form a third mixture in at least a second static mixing drum, and separating from the third mixture a third sulfolane-depleted stream, wherein the concentration of sulfolane in the third sulfolane-depleted stream is less than the concentration of sulfolane in the second sulfolane-depleted stream.

Embodiment J

The process of any one of Embodiments B-I, further comprising separating one or more sulfolane-enriched streams from the second and/or third mixtures.

Embodiment K

The process of Embodiment J, further comprising recycling at least a portion of the one or more sulfolane-enriched streams to the raffinate wash column.

Embodiment L

The process of any one of Embodiments I-K, further comprising combining said third sulfolane-depleted stream with a fourth polar liquid, which may be the same as or different than the first and second polar liquids, to form a fourth mixture in at least a third static mixing drum, and separating from the fourth mixture a fourth sulfolane-depleted stream, wherein the concentration of sulfolane in the fourth sulfolane-depleted stream is less than the concentration of sulfolane in the third sulfolane-depleted stream.

Embodiment M

The process of any one of Embodiments A-L, wherein the concentration of sulfolane in the second sulfolane-depleted stream is ≤50 ppm, particularly about 0 to about 50 ppm, about 0 to about 20 ppm, about 0 to about 5 ppm, or about 0 to about 2 ppm.

Embodiment N

The process of any one of Embodiments A-B or D-M, wherein the hydrocarbon-containing stream comprises a raffinate stream from an extractive desulfurization process.

Embodiment O

The process of any one of Embodiments C-N, wherein said combining occurs in said raffinate wash column.

Embodiment P

An apparatus for the purification of a hydrocarbon-containing stream comprising sulfolane, the apparatus comprising: (a) a first counter-current separation unit; (b) a second counter-current separation unit; and (c) a counter-current solvent circulation system in fluid communication with the first counter-current separation unit and the second counter-current separation unit; wherein the first and second separation units are selected from the group consisting of a raffinate wash column and at least one raffinate wash drum, wherein the first and second separation units are different; particularly wherein the first counter-current separation unit comprises a raffinate wash column and the second counter-current separation unit comprises at least one raffinate wash drum.

All documents described herein are incorporated by reference herein for purposes of all jurisdictions where such practice is allowed, including any priority documents and/or testing procedures to the extent they are not inconsistent with this text, provided however that any priority document not named in the initially filed application or filing documents is not incorporated by reference herein. As is apparent from the foregoing general description and the specific embodiments, while forms of the invention have been illustrated and described, various modifications can be made without departing from the spirit and scope of the invention. Accordingly, it is not intended that the invention be limited thereby. Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa. Aspects of the invention include those that are substantially free of or essentially free of any element, step, composition, ingredient or other claim element not expressly recited or described.

What is claimed is:

1. A method for the purification of a hydrocarbon-containing stream comprising sulfolane, the method comprising:

(a) separating a first sulfolane-depleted stream from a hydrocarbon stream in a first counter-current separation unit by contacting the hydrocarbon stream with a first polar fluid;

(b) providing the first sulfolane-depleted stream to a second counter-current separation unit;

(c) separating a second sulfolane-depleted stream from the first sulfolane-depleted stream by contacting the first sufolane-depleted stream with a second polar fluid in the second counter-current separation unit;

(d) providing the second sufolane-depleted stream to a third counter-current separation unit; and (e) separating a third sufolane-depleted stream from the second sufolane-depleted stream by contacting the second sufolane-depleted stream with a third polar fluid in the third counter-current separation unit, wherein the first and second counter-current separation units are selected from the group consisting of a raffinate wash column and at least one raffinate wash drum, and wherein the first and second counter-current separation units are different.

2. The method of claim 1, wherein the first counter-current separation unit comprises at least one raffinate wash drum and the second counter-current separation unit comprises a raffinate wash column.

3. The method of claim 1, wherein the first counter-current separation unit comprises a raffinate wash column and the second counter-current separation unit comprises at least one raffinate wash drum.

4. A method for the purification of a hydrocarbon-containing stream comprising sulfolane, the method comprising:

(a) combining a hydrocarbon-containing stream with a first polar liquid to form a first mixture in a raffinate wash column;

(b) separating from said first mixture a first sulfolane-depleted stream and a first sulfolane-enriched stream;

(c) combining said first sulfolane-depleted stream with a second polar liquid to form a second mixture;

(d) separating a second sulfolane-depleted stream from the second mixture in at least one raffinate wash drum; and (e) recycling at least a portion of said second sulfolane-depleted stream to the raffinate wash column, wherein the concentration of sulfolane in the second sulfolane-depleted stream is less than the concentration of sulfolane in the first sulfolane-depleted stream.

5. The method of claim 4, wherein the first and second polar liquid may be the same or different, and wherein the first and second polar liquids are selected from the group consisting of water, $C_1$-$C_4$ alcohols, and mixtures thereof.

6. The method of claim 4, wherein the raffinate wash column provides 1 to 10 theoretical stages.

7. The method of claim 4, further comprising combining said second sulfolane-depleted stream with a third polar liquid, which may be the same as or different than the first and second polar liquids, to form a third mixture in at least a second static mixing drum and separating a third sulfolane-depleted stream from the third mixture, wherein the concentration of sulfolane in the third sulfolane-depleted stream is less than the concentration of sulfolane in the second sulfolane-depleted stream.

8. The method of claim 7, further comprising separating second and third sulfolane-enriched streams from the second and third mixtures, respectively.

9. The method of claim 8, further including recycling at least a portion of the second and/or third sulfolane-enriched streams to the raffinate wash column.

10. The method of claim 7, further comprising combining said third sulfolane-depleted stream with a fourth polar liquid, which may be the same as or different than the first and second polar liquids, to form a fourth mixture in at least a third static mixing drum and separating a fourth sulfolane-depleted stream from the fourth mixture, wherein the concentration of sulfolane in the fourth sulfolane-depleted stream is less than the concentration of sulfolane in the third sulfolane-depleted stream.

11. The method of claim 4, wherein the concentration of sulfolane in the second sulfolane-depleted stream is ≤50 ppm.

12. The method of claim 4, wherein the hydrocarbon-containing stream comprises a raffinate stream from an extractive desulfurization process.

13. A method of removing reducing sulfur content of a hydrocarbon-containing stream comprising:

(a) extracting a hydrocarbon-containing stream with sulfolane to form a sulfolane-rich extract and a hydrocarbon-containing raffinate, said raffinate containing an amount of sulfolane and having an amount of sulfur-containing compounds therein that is less than an amount of sulfur-containing compounds in the hydrocarbon-containing stream;

(b) combining the raffinate with a first polar liquid to form a first mixture, (c) separating from said first mixture a first sulfolane-depleted stream in a raffinate wash column;

(d) in at least a first static mixing drum, combining said first sulfolane-depleted stream with a second polar liquid to form a second mixture;

(e) separating a second sulfolane-depleted stream from the second mixture; and (f) recycling at least a portion of said second sulfolane-depleted stream to the raffinate wash column, wherein the concentration of sulfolane in the second sulfolane-depleted stream is less than the concentration of sulfolane in the first sulfolane-depleted stream.

14. The method of claim 13, wherein the first and second polar liquid may be the same or different, and wherein the first and second polar liquids are selected from the group consisting of water, $C_1$-$C_4$ alcohols, and mixtures thereof.

15. The method of claim 13, wherein the raffinate wash column provides 1 to 10 theoretical stages.

16. The method of claim 13, further comprising combining said second sulfolane-depleted stream with a third polar liquid, which may be the same as or different than the first and second polar liquids, to form a third mixture in at least a second static mixing drum and separating from the third mixture a third sulfolane-depleted stream, wherein the concentration of sulfolane in the third sulfolane-depleted stream is less than the concentration of sulfolane in the second sulfolane-depleted stream.

17. The method of claim 16, further comprising separating second and third sulfolane-enriched streams from the second and third mixtures, respectively.

18. The method of claim 17, further including recycling at least a portion of the second and/or third sulfolane-enriched streams to raffinate wash column.

19. The method of claim 16, further comprising combining said third sulfolane-depleted stream with a fourth polar liquid, which may be the same as or different than the first and second polar liquids, to form a fourth mixture in at least a third static mixing drum and separating from the fourth mixture a fourth sulfolane-depleted stream, wherein the concentration of sulfolane in the fourth sulfolane-depleted stream is less than the concentration of sulfolane in the third sulfolane-depleted stream.

20. The method of claim 13, wherein the concentration of sulfolane in the second sulfolane-depleted stream is ≤50 ppm.

* * * * *